United States Patent [19]

Wisniewski et al.

[11] 4,390,210

[45] Jun. 28, 1983

[54] BLIND CONNECTING STRUCTURE FOR INNER AND OUTER SHELLS OF CHAIR BACK

[75] Inventors: Joseph M. Wisniewski, Marne; Walter C. Mrotz, III, Comstock Park, both of Mich.

[73] Assignee: Haworth Mfg., Inc., Holland, Mich.

[21] Appl. No.: 216,734

[22] Filed: Dec. 15, 1980

[51] Int. Cl.[3] ..... A47C 7/40

[52] U.S. Cl. ..... 297/452; 297/444; 403/372

[58] Field of Search ..... 297/452, 444; 411/526, 411/519, 353, 516; 403/372

[56] References Cited

U.S. PATENT DOCUMENTS

| | | | |
|---|---|---|---|
| 2,440,470 | 4/1948 | Greitzer | 297/444 |
| 2,621,947 | 11/1952 | Markvart | 287/53 |
| 2,630,857 | 3/1953 | Cohen | 297/444 |
| 2,673,600 | 3/1954 | Cramer | 297/452 |
| 2,950,937 | 8/1960 | Bedford | 287/126 |
| 3,007,726 | 11/1961 | Parkin | 287/53 |
| 3,037,814 | 6/1962 | Gardner et al. | 297/444 |
| 3,295,891 | 1/1967 | Brown | 297/452 |
| 3,345,103 | 10/1967 | Parkin et al. | 292/353 |
| 3,483,789 | 12/1969 | Wurzel | 85/8.8 |

*Primary Examiner*—Francis K. Zugel

*Attorney, Agent, or Firm*—Flynn, Thiel, Boutell & Tanis

[57] ABSTRACT

A back structure for a chair including a cushion overlying an interior panel. The cushion has edge portions which wrap around the interior panel. A back panel is spaced from the interior panel, and the opposed edge portions of the panels clamp the edge portions of the cushion therebetween. A plurality of hidden connecting structures fixedly join the panels together. The connecting structure comprises a hub fixed to and projecting outwardly from one of the panels, and a shaft-like projection fixed to the other panel and projecting therefrom into the hub. A one-piece resilient fastener ring is positioned within the hub and has a first set of spring teeth which grippingly engage the hub and a second set of spring teeth which grippingly engage the projection for preventing the latter from being axially withdrawn from the hub.

2 Claims, 5 Drawing Figures

BLIND CONNECTING STRUCTURE FOR INNER AND OUTER SHELLS OF CHAIR BACK

FIELD OF THE INVENTION

This invention relates to an improved structure for a chair and, more particularly, to an improved connecting structure for use within an upholstered chair back for fixedly securing the outer shell of the chair back to the inner support or shell.

BACKGROUND OF THE INVENTION

Commercial or office-type chairs, including secretarial and executive chairs, typically employ a chair back of the upholstered type. That is, the chair back employs an inner support panel or shell on which is positioned a suitable cushion, and a covering such as of fabric or vinyl is typically wrapped around the cushion. The outer edge portions of the cushion and covering wrap around the outer edges of the intermediate shell, which outer edge portions of the cushion and covering are normally suitably clamped between the inner shell and the back panel (that is, the outer shell) of the chair back. This outer shell, which defines the exposed exterior rear surface of the chair back, is fixedly anchored to the inner shell by various types of connecting or anchoring structures. While chair backs of this general type have been developed and utilized for many years, nevertheless the fixed connection of the outer shell to the inner shell, and specifically the type of connecting or anchoring structure utilized, has long presented a problem to chair designers. Many of the utilized structures have been less than desirable but have nevertheless been extensively used in view of the difficulties in overcoming the disadvantages.

For example, for many years a great number of chair manufacturers did, and many manufacturers still do, utilize threaded fasteners such as screws for fixedly securing or joining together the inner and outer shells of the chair back. With this type of structure, the outer shell is provided with suitable openings through which the screws extend so that the screws can be threaded to the inner shell, with the screw heads typically being of a configuration so as to seat more or less flush with the outer surface of the outer shell in an attempt to disguise or hide their appearance. Nevertheless, with this arrangement, the screw heads are still visible and hence detract and oftentimes destroy the esthetics of the chair. Further, the installation and securement of the screws between the inner and outer shells is a difficult and time-consuming installation or assembly operation. In addition, if the screws are not properly installed and tightened, they can be accidentally over-tightened and hence cause undesired compression or deflection of the outer shell, particularly since the outer shell is normally molded or formed from plastic or metal, and this thus destroys the appearance of the chair.

In an attempt to avoid use of exposed screws or fasteners, one chair manufacturer has adopted a connecting structure wherein separate connecting parts are glued or adhesively bonded to the opposed surfaces of the inner and outer shells, which parts are then fixedly snapped together during assembly of the chair back so as to fixedly relate the inner and outer shells to one another. With this connecting structure, however, the inner and outer shells are always fixedly related in the same special relationship, inasmuch as this connecting structure provides no adjustability with respect to the spacing between the inner and outer shells. With chair backs, however, this lack of adjustment creates a significant problem inasmuch as the edge of the cushion and/or covering which overlaps and is clamped between the opposed edges of the inner and outer shells may vary substantially from chair to chair. Hence, the desired spacing between the inner and outer shells also suitably varies, depending upon the quantity of cushion and covering clamped between the opposed edges of the shells, in order to achieve optimum clamping of the cushion and covering. The lack of adjustment in this known structure thus can create difficulty in not only assembling some of the chair backs, but can also result in improper securement or clamping of the edges of the cushion and covering.

Another problem encountered with connecting structures of this latter type occurs due to the fact that the outer shell is typically injection molded from a plastic material, specifically polypropylene. Due to the snap-type fixed structural connection between the inner and outer shells, coupled with the variable clamping pressure which it thus creates on the edges of the cushion and covering, the connecting parts which are fixedly secured to the outer shell can cause excessive stress to be imposed on the outer shell, which outer shell may become deformed and thus exhibit stress cracks, commonly referred to as "white-out" on the exterior surface of the outer shell. This thus destroys the appearance, and hence saleability, of the chair.

In a further attempt to avoid use of threaded fasteners and the like so as to provide a blind or hidden connecting structure for joining the inner and outer shells, and at the same time retain at least limited adjustability with respect to the spacing between the inner and outer shells to avoid the problems encountered with the above-mentioned snap-type connecting structure, another chair manufacturer has adopted a hidden or blind type connecting structure which employs what is often referred to as a "Christmas tree" fastener. With this arrangement, the outer shell is provided with several hollow bosses integrally molded on the inner side thereof. The so-called Christmas tree fastener is conventionally molded of plastic and includes a head portion having a large number of circumferentially and axially spaced radial projections. The other end of the fastener is provided with an enlarged base. The enlarged base of the fastener is inserted into the hollow boss, and a conventional washerlike spring clip is passed over the head portion and moved into the enlarged boss. The spring clip has external resilient teeth for gripping the enlarged boss to thereby fixedly lock the base of the Christmas tree fastener to the outer shell. The outer shell, having the Christmas tree fasteners fixed thereto, is then fixedly secured to the inner shell or panel by means of the Christmas tree (i.e., the head portion) being inserted into openings formed in the inner shell. While this arrangement does permit the inner and outer shells to be fixedly secured while at the same time axially adjustably related to compensate for variations in the cushion and/or covering thickness, nevertheless this arrangement is structurally complex since it requires two separate parts for joining the two shells, namely the Christmas tree fastener and the spring clip. This arrangement is also more expensive to manufacture and assemble in view of the complexities involved in molding the Christmas tree fastener, and the additional complications and time required to initially assemble the Christmas tree fastener and spring clip to the outer shell.

Thus, the present invention relates to an improved fastener and connecting structure for joining the inner and outer shells of a chair back while permitting the spacing therebetween to be suitably adjusted, which improved connecting structure overcomes the aforesaid disadvantages.

The improved connecting structure of this invention involves a single fastener for fixedly connecting the inner and outer shells. The connecting structure involves a pinlike projection fixed on and projecting from one of the shells, and a hollow hub fixed on and projecting from the other shell, which hub is adapted to receive the pinlike projection therein. The hub and pinlike projection are axially fixedly connected by the fastener which is formed as a washerlike spring clip having a set of exterior resilient teeth which slope toward one side of the fastener, and a set of interior resilient teeth which slope toward the other side of the fastener. The fastener is initially seated against a shoulder formed within the hub so that the external teeth grippingly engage the hub and prevent removal of the fastener. The pinlike projection can then be axially slidably inserted through the fastener to the desired extent, whereupon the interior teeth grippingly engage the pinlike projection and prevent withdrawal of same. The inner and outer shells are thus fixedly joined together in a manner whereby the outer shell can be a continuous and non-interrupted structure free of visible screws or protrusions, whereupon this improved connecting structure is thus totally hidden and hence effectively constitutes a blind connection. The fastener permits the two shells to be moved toward one another to the extent necessary so as to provide optimum clamping between the edges of the shells for holding the confined edges of the cushion and/or cover. The pinlike projection can thus be inserted into the hub to the extent necessary to achieve optimum clamping of the cushion and/or cover, and the fastener will then fixedly axially secure the pinlike projection and hub together so as to maintain the desired clamping relationship between the opposed edges of the shells.

This improved fastening structure, as it relates to a chair back, is highly desirable since it greatly simplifies the structure of the chair inasmuch as only a single element, namely the washerlike fastener, is necessary for creating the fixed connection between the inner and outer shells, whereupon the number of components and hence both the manufacture and assembly of the chair is substantially minimized. At the same time, this arrangement permits optimum clamping of the cushion and covering between the opposed edges of the shells, and also readily accommodates any variation in the cushion and/or covering, or any variation in the shells, so that the same arrangement can be successfully utilized for large numbers of chairs of either the same or different design or style. The resulting chair is highly advantageous since the exposed exterior surface of the outer shell can be smooth and thus of pleasing appearance, inasmuch as it is free of exposed screw heads and the like, and is also free of any interior connections which may cause undesirable stress cracks inasmuch as the clamping pressure imposed on the cushion edges as trapped between the opposed shell edges can be more precisely controlled and maintained.

Other objects and purposes of the invention will be apparent to persons familiar with structures of this general type upon reading the following specification and inspecting the accompanying drawings.

Figures 1, 2:
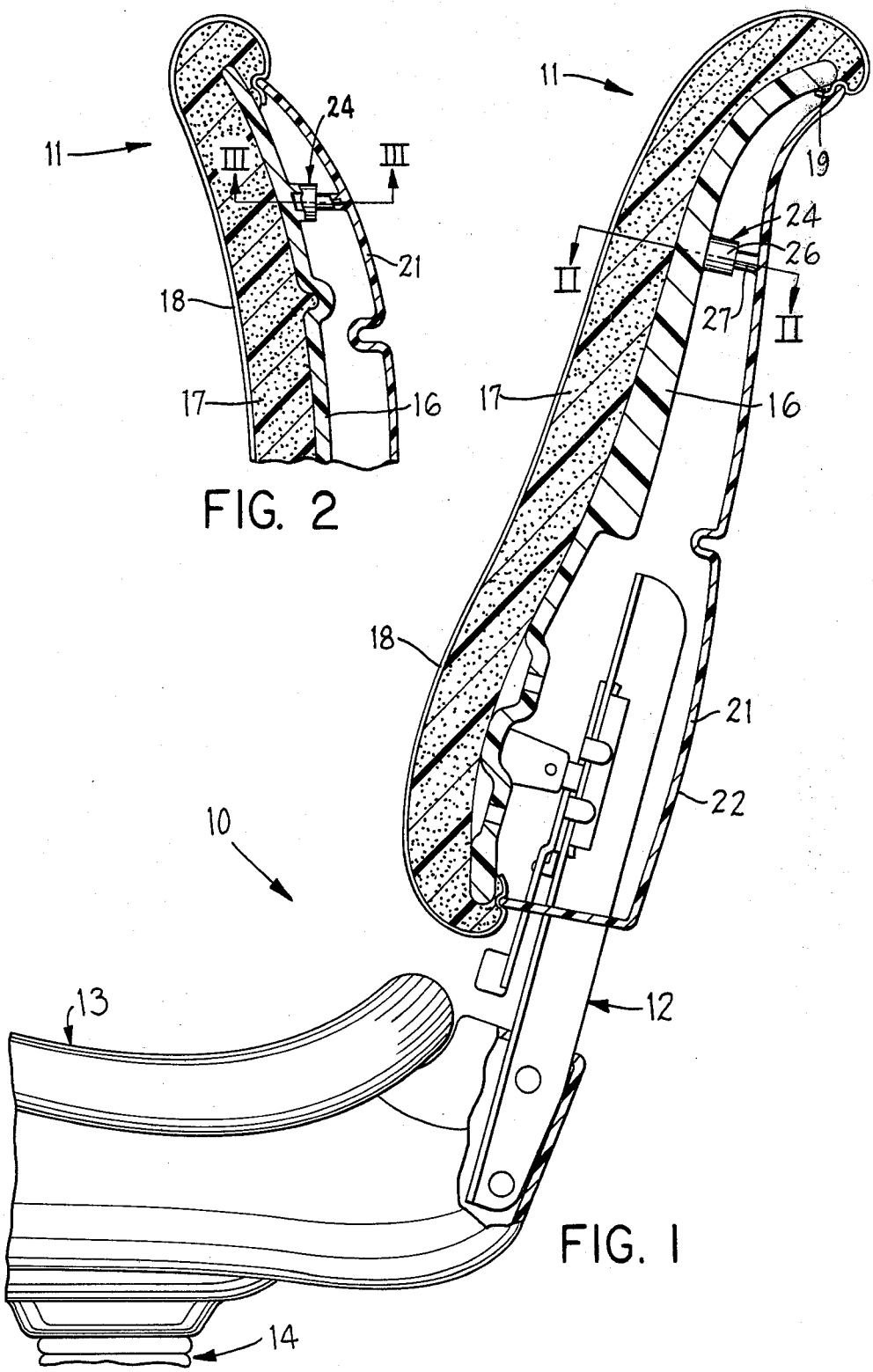
FIG. 1 is a side elevational view, partially in cross section, illustrating a commercial chair, specifically an office-type chair, incorporating in the back thereof the improved connecting structure of this invention.
FIG. 2 is a fragmentary sectional view taken substantially along line II—II in FIG. 1.

Certain terminology will be used in the following description for convenience and reference only, and will not be limiting. For example, the words "upwardly", "downwardly", "leftwardly" and "rightwardly" will refer to directions in the drawings. The work "back" when used in a directional sense will have reference to the rear side of the chair, namely the right side as appearing in FIG. 1. The words "inwardly" and "outwardly" will refer to directions toward and away from, respectively, the geometric center of the chair or designated parts thereof. Said terminology will include the words specifically mentioned, derivatives thereof, and words of similar import.

DETAILED DESCRIPTION

FIG. 1 illustrates one form of commercial chair 10, specifically an office-type chair. The chair 10, as is conventional, includes a back portion 11 which is connected through any standard mechanism 12 to a seat portion 13, the latter being suitably supported by a pedestal or leg arrangement 14. The configuration and structure of the various components and portions of the chair may assume many different shapes and arrangements, and the chair 10 shown in FIG. 1 is solely for purposes of illustration.

Considering the back portion 11, same includes an interior support panel 16, hereinafter referred to as the interior or intermediate shell. This interior shell 16 is substantially coextensive with the back portion 11 and, in the illustrated embodiment, is preferably molded from a plastics material so that it may be provided with a suitable contour consistent with or corresponding to the desired contour of the back portion. This interior shell 16 has the forwardly facing surface thereof covered with a suitable cushion 17, such as a foam-type cushion, and the latter is in turn generally covered with a suitable covering 18, which covering normally comprises a sheetlike material such as fabric, vinyl or leather. The edge portions of the cushion 17 and covering 18 are suitably wrapped around the edges of the interior shell 16, such as illustrated by the edge portions designated 10 in FIG. 1.

The back portion 11 of the chair also includes an outer shell or back panel 21, which outer shell 21 is spaced from the interior shell 16 to define a space therebetween in which is positioned the support mechanism 12. The outer or rear exterior surface 22 of this outer shell 21 defines the exposed rear surface of the back portion, and hence the visual appearance of this outer shell 21 is important with respect to the overall appearance of the chair.

This outer shell 21 is substantially coextensive with the intermediate shell 16, and in fact these shells 16 and 21 have their edges positioned closely adjacent one another. These opposed shells 16 and 21 are suitably fixedly joined together, as by means of a plurality of connecting structures 24 which are described hereinafter, whereupon the wrap-around edge portions 19 of the cushion 17 and covering 18 are thus clampingly held between the opposed edge portions of the shells. However, since the thickness of the edge portion 19 may vary from chair to chair, or may vary from location to location on the same chair, the connecting structure 24 is designed to permit the shells 16 and 21 to be fixedly joined together in a desired spaced relationship, while at the same time this connecting structure 24 permits adjustment or variation in the spacing between the opposed edges of the shells so as to provide for optimum and substantially uniform clamping of the cushion edge portions 19 without creating excessive or difficult assembly problems, and without causing undesired distortion or deflection of the shells.

Figure 3:
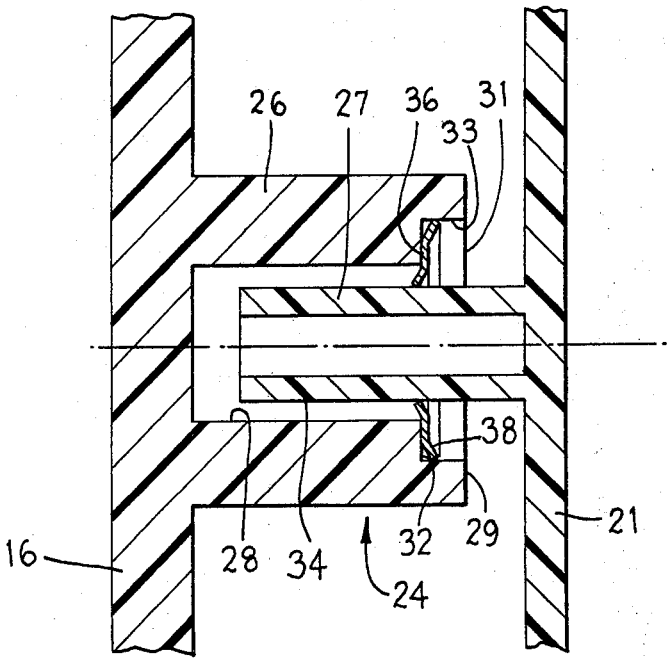
FIG. 3 is an enlarged, fragmentary sectional view showing the connecting structure for joining the inner and outer shells.

Considering now the connecting structure 24, as illustrated in detail in FIG. 3, same includes cooperative portions 26 and 27 which are fixedly associated with the shells 16 and 21, respectively. The portion 26 comprises a sleevelike hub which is fixedly, here integrally, joined to the shell 16, the hub 26 being molded as an integral part of the shell. The other portion 27 is also fixed, here being integrally molded, to the back shell 21. This other portion 27 comprises a substantially cylindrical pin or shaft, the latter being either hollow or solid, which projects rearwardly from the back shell 21 and is adapted to extend axially into the hub 26.

The hub 26 defines therein a bore 28 which opens inwardly of the hub from the end wall 29 located at the free end thereof. This bore 28 is, in the illustrated embodiment, closed at one end, the bore 28 thus being of the "blind" variety. The bore 28, at its end wherein it projects through the end wall 29, defines a substantially circular opening 31 which provides access into the bore.

The hub 26, at the free end thereof, is provided with an enlarged annular recess 33 which extends inwardly from the end opening 31 through a limited annular extent, which recess is terminated at its inner end by an annular radially-inwardly projecting shoulder 32. This latter-mentioned annular recess, which extends between the end opening 31 and the shoulder 32, is thus surrounded by an inner annular surface defined on the hub 26. This annular surface or recess 33 is of a diameter which is slightly greater than the diameter of the main portion of the bore 28, so that the annular shoulder 32 thus extends radially between the peripheral wall of the bore 28 and the peripheral surface 33.

The shaft 27 has an exterior diameter which is substantially smaller than the diameter of the bore 28 so that the shaft 27 can thus be freely inserted into the bore 28. When so positioned, the exterior annular peripheral surface 34 of shaft 27 is thus spaced from the inner peripheral surface of the bore 28.

To fixedly and centrally position the shaft 27 within the bore 28, the present invention provides an improved fastener or gripping member 36 for axially securing the hub 26 and shaft 27 together so as to create a desired structural connection between the shells 21 and 16, which structural connection is of the hidden or blind type.

Figure 4:
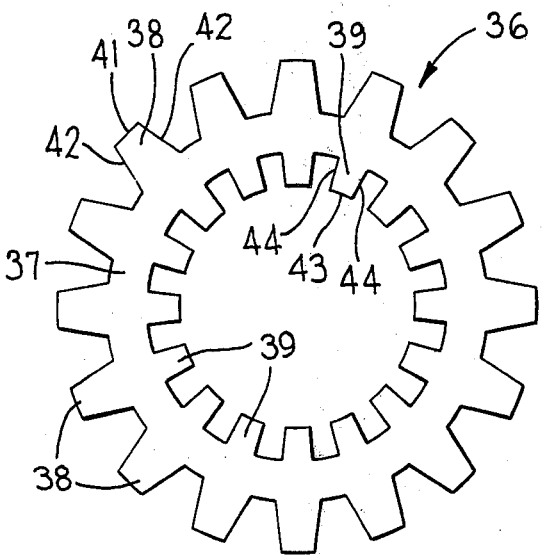
FIG. 4 is a plan view, on an enlarged scale, of the fastener.
Figure 5:
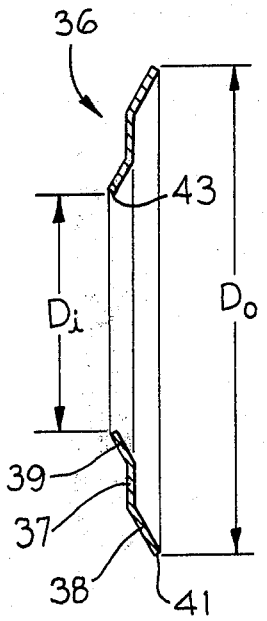
FIG. 5 is a somewhat diagrammatic sectional view of the fastener shown in FIG. 4.

The fastener 36, as illustrated by FIGS. 4 and 5, is constructed substantially as a ring and includes a substantially flat platelike washer 37 having a set of outer or external teeth 38 projecting outwardly from the outer peripheral edge thereof, and a similar set of inner or internal teeth 39 projecting inwardly from the inner peripheral edge thereof. The outer teeth 38 are uniformly spaced around the complete periphery of the washer 37, and the inner teeth 39 are similarly uniformly spaced therearound. In the illustrated embodiment, there are equal numbers of inner and outer teeth, there being 16 such teeth in each set. Further, the external teeth 38 are disposed so that the radial centerlines thereof are aligned with the radial centerlines of the respectively adjacent internal teeth 39.

The outer teeth 38 are of a tapered configuration so that the tooth terminates in an outer free edge 41, commonly referred to as the gripping edge. The opposite side edges 42 of each outer tooth 38 are of a converging tapered relationship as they project toward the outer free edge 41.

The inner teeth 39 are similarly shaped in that they are also of a tapered configuration defined by converging tapered side edges 42 which terminate at the inner gripping edge 43.

The individual outer teeth 38 project radially outwardly away from the outer radial edge of the washer 37 but are suitably sloped or inclined relative to the plane of the washer 37, so that the outer teeth 38 are thus offset axially to one side of the washer 37. The inner teeth 39 are similarly sloped or angled relative to the plane of the washer 37, so that as the teeth 39 project radially inwardly, they are also sloped so as to project axially toward the opposite side of the washer 37.

The complete fastener 36 is formed as an integral one-piece element, such as by being formed from a thin sheet of metal, preferably spring steel having a thickness typically in the range of 0.015 to 0.040 inch. Thus, the teeth 38 and 39 effectively function as spring fingers, in that they can be readily resiliently deformed or deflected during utilization of the fastener.

While the slope or angle of the spring teeth 38 and 39 is preferably in the neighborhood of 30°, it will be appreciated that the angle or slope can deviate therefrom, such as between approximately 20° and 40°, without interfering with the capability of the fastener to create a secure structural connection between the shells 21 and 16. While the washer 37 may deviate slightly from its flat condition and assume a somewhat rounded or curved cross section in view of the residual stresses in the fastener caused by the forming operation, it will be appreciated that this does not affect either the structure of the fastener or its operation.

The outside diameter $D_o$ of the non-deformed fastener, as defined by the outer gripping edges 41 of the outer teeth 38, is preferably slightly greater than the diameter of the recess 33, such as in the order of 0.03 to 0.06 inch. Similarly, the inner Diameter $D_i$ of the non-deformed fastener, as defined by the inner gripping edges 43, is slightly smaller than the outer diameter of the shaft 27, this difference also normally being in the range of 0.03 to 0.06 inch. These inner and outer diameters of the fastener, which exist when the fastener is in its non-used and hence non-deformed condition illustrated in FIGS. 4 and 5, hence permits the spring fingers 38 and 39 to be suitably resiliently deformed or deflected, and thus grippingly engage the structural parts or portions 26 and 27 respectively, as explained hereinafter.

OPERATION

The assembly and operation of the fastener 36, and its relationship to the shells 21 and 16 for joining same together, will be briefly explained to insure a complete understanding thereof.

To assemble the shells 21 and 16 together by means of the connecting structure 24, the fastener 36 is initially inserted into the recess 33 of hub 26 with the outer teeth 38 being sloped outwardly, which insertion continues until the washer 37 abuts the shoulder 32. During this insertion, the outer teeth 38 are necessarily resiliently deflected inwardly a limited extent inasmuch as the recess 33 is of slightly smaller diameter than the outer diameter $D_o$ of the fastener when the latter is in its non-deformed state. In view of the slope of the teeth 38, the teeth 38 will readily resiliently deflect inwardly during the inserting step, with the outer gripping edges 41 of the teeth sliding along the peripheral wall 33 until the washer 37 abuts the shoulder 32. When the fastener 36 is thus positioned within the hub 26, removal of the fastener 36 is effectively prevented by the gripping engagement between the outer gripping edges 41 and the surrounding peripheral wall 33, which gripping engagement prevents the fastener from being moved axially outwardly (leftwardly in FIG. 3) from the hub.

With the fastener positioned within the hub as explained above, the shaft 27 can then be axially inserted into the hub 26, which insertion causes the inner teeth 39 to be slightly resiliently deformed or deflected inasmuch as the inner diameter $D_i$ of the fastener, when in its non-deformed state, is smaller than the exterior diameter of the shaft 27. Again, in view of the inward slope of the teeth 39, the shaft 27 can be axially inserted into the hub 26 through any desired extent. However, when the shaft 27 has been inserted the desired amount, then axial withdrawal of the shaft 27 from the hub 26 is effectively prevented due to the gripping engagement which exists between the inner gripping edges 43 associated with the teeth 39, and the exterior peripheral surface 34 of the shaft 27. Thus, the shells 21 and 16 are effectively locked together due to the concentric structural connection between the portions 26 and 27, and the cooperation therebetween of the fastener 36. While this fastener 36 will enable the shells 21 and 16 to be moved relative to one another in one direction, namely toward one another in FIG. 1 due to the one-way gripping effect created by the fastener 36, nevertheless this fastener will not permit non-destructive separation between the shells.

As is readily apparent from FIG. 3, the fastener 36 thus permits the two shells to be fixedly or lockingly joined together in a fashion whereby the resulting connection therebetween is effectively hidden or disposed interiorly of the back portion 11, so as to not detract from the exterior or exposed surfaces thereof, such as the exterior surface 22 of the shell 21. The present invention thus greatly facilitates the creation of an effective structural connection between the two shells 21 and 16 while utilizing an extremely simple and efficient connecting structure which greatly facilitates the creation of the desired structural connection.

While the above description relative to the joining together of the shells 16 and 21 relates solely to a single connecting structure 24, it will be appreciated that the shells 16 and 21 have several such connecting structures 24 cooperating therebetween to provide the desired structural connection between the shells. For example, the back portion 11, in the illustrated embodiment, is preferably provided with a first pair of sidewardly spaced connecting structures 24 disposed adjacent the upper portion thereof, substantially as illustrated by FIGS. 1 and 2, and a further pair of sidewardly spaced connecting structures 24 coact between the shells adjacent the lower part of the back portion 11. This connecting structure is highly desirable since, as is apparent from the above description, it permits the shells 16 and 21 to be relatively moved toward one another and fixedly held in a selected position so as to provide for optimum clamping of the cushion edges 19 between the opposed edge portions of the shells, while at the same time compensating for any variations in the cushion edge portions, inasmuch as a proper locking relationship is created between the shells even though the exact spacing between the edge portions of the shells may vary either from chair to chair or within a single chair.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a leg-supported seat structure and a back structure projecting upwardly from the seat structure, the back structure including an interior support panel and a cushion structure overlying the front-facing surface of the support panel, the cushion structure having edge portions which wrap around the edge portions of the interior support panel, the back structure also including a back panel which is spaced from but substantially coextensive with the interior support panel and defines the exterior rear surface of the back structure, the opposed edge portions of the interior and back panels clamping the edge portions of the cushion structure therebetween, and a plurality of hidden connecting structures disposed between and fixedly joining said interior and back panels together, the improvement wherein said connecting structures permit the spacing between the panels to vary during assembly to compensate for the interposed edge portions of the cushion structure, each said connecting structure comprising:

a sleevelike hub fixed to and projecting outwardly from one of said panels toward the other said panel, said hub defining therein a cylindrical opening which projects axially inwardly of the hub from the free end thereof, means fixedly associated with said hub for defining a substantially annular shoulder which projects radially inwardly into said opening at a location spaced axially inwardly from the free end thereof, said shoulder being directed axially toward the free end of said hub, and said opening being of a stepped configuration and including (1) a first opening portion which extends from said free end to said shoulder and (2) a second elongated opening portion which is of substantially smaller diameter and extends axially inwardly of said hub from said shoulder;

a cylindrical shaftlike projection fixed to the other panel and projecting outwardly therefrom toward said one panel, said projection having a cross section which is substantially smaller than the diameter of said second opening portion so as to enable said projection to project axially into said hub through a sufficient distance so as to pass a substantial distance axially past said shoulder with a substantial annular clearance space being defined between said projection and the boundary walls of said first and second opening portions;

said interior panel having a nonplanar contour and being molded of a plastics material, said hub being integral with and projecting rearwardly from said interior panel, said back panel having a nonplanar contour and being molded of a plastics material, said projection being integral with said back panel and projecting forwardly therefrom;

one-piece resilient fastener ring means positioned between said projection and said hub and grippingly engaging both thereof to prevent said projection from being relatively axially withdrawn from said hub while enabling the projection to be axially inserted into said hub through any selected axial extent while still permitting the projection to be axially fixed relative to the hub to thereby provide for optimum clamping of the edge portions of the cushion structure between the opposed edge portions of the interior and back panels, said ring means maintaining said hub and projection in spaced relationship wherein they are free of sliding or abutting surface engagement;

said one-piece resilient fastener ring means including a first set of spring teeth which grippingly engage a surrounding wall on said hub for preventing said ring means from being axially withdrawn from said hub through the free end thereof, said ring means also including a second set of spring teeth which grippingly engage the exterior peripheral surface of the projection for preventing the latter from being axially withdrawn from the hub through the free end thereof;

said fastener ring means comprising a substantially flat platelike washer seated on said shoulder, said first set of teeth comprising outer teeth which are fixed to the outer peripheral edge of the washer and project radially outwardly therefrom for gripping engagement with the hub wall defining said first opening portion, and the second set of teeth comprising inner teeth which are fixed to the inner peripheral edge of the washer and project radially inwardly thereof for gripping engagement with the exterior peripheral surface of the projection, said outer teeth sloping axially toward the free end of the hub as they project radially outwardly, and said inner teeth sloping axially away from the free end of the hub as they project radially inwardly, whereby the outer and inner teeth slope in axially opposite directions so that they each create a one-way gripping engagement which prevents both the fastener ring means and the projection from being moved axially relative to the hub toward the free end thereof, said fastener ring means permitting the projection to be freely axially moved relative to the hub in the other axial direction; and said flat platelike washer having an inner diameter which is approximately the same as the inner diameter of said annular shoulder so that said inner teeth project radially inwardly therefrom across said annular clearance space to facilitate the resilient deformation of the inner teeth and their gripping engagement with the exterior peripheral surface of said projection.

2. In a chair according to claim 1, wherein said plurality of hidden connecting structures includes a first pair of said connecting structures disposed in sidewardly spaced relationship and positioned adjacent the upper portions of the panels for fixedly connecting same together, and a second pair of said connecting structures disposed in sidewardly spaced relationship and positioned adjacent the lower portions of said panels for fixedly connecting same together, whereby said interior and back panels are fixedly joined together solely by said plurality of hidden connecting structures for clampingly engaging the edge portions of the cushion structure between the opposed edge portions of the panels while maintaining the exterior rear surface of the back panel smooth and continuous and free of visible fasteners.

* * * * *